United States Patent [19]

Fritsche et al.

[11] Patent Number: 4,590,639

[45] Date of Patent: May 27, 1986

[54] DOOR CLOSER

[75] Inventors: Karl Fritsche; Wilhelm Vahs, both of Stuttgart, Fed. Rep. of Germany

[73] Assignee: Geze GmbH, Leonberg, Fed. Rep. of Germany

[21] Appl. No.: 494,928

[22] Filed: May 16, 1983

[30] Foreign Application Priority Data

Jun. 29, 1982 [DE] Fed. Rep. of Germany ..... 3224300

[51] Int. Cl.[4] ..... E05F 1/08

[52] U.S. Cl. ..... 16/79; 16/DIG. 39; 116/204

[58] Field of Search ..... 16/69, 64, DIG. 10, 16/79, 298–301; 116/204, 282, 283, 321; 267/175, 177

[56] References Cited

U.S. PATENT DOCUMENTS

| | | | |
|---|---|---|---|
| 1,791,896 | 2/1931 | Henning | 267/175 |
| 2,139,592 | 12/1938 | Kirby | 267/177 |
| 2,660,719 | 11/1953 | Stromberg | 116/204 |
| 3,934,307 | 1/1976 | Lasier et al. | 16/79 |

FOREIGN PATENT DOCUMENTS

| | | | |
|---|---|---|---|
| 2819334 | 11/1979 | Fed. Rep. of Germany | 16/79 |
| 41-14417 | 4/1966 | Japan | 116/204 |

*Primary Examiner*—Donald R. Schran
*Assistant Examiner*—James L. Wolfe

[57] ABSTRACT

A door closer the closing force of which can be adjusted is provided with a device for indicating the selected closing force. The device used to indicate the prevailing closing force is actuated in dependence on the adjustment of the spring which determines the closing force.

1 Claim, 9 Drawing Figures

DOOR CLOSER

Figure 1:
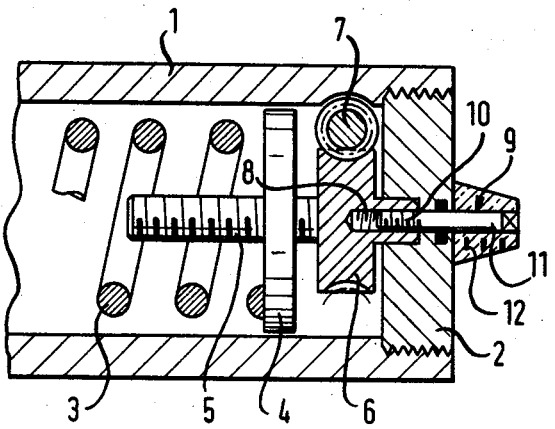

The invention relates to a door closer, the closing force of which is adjustable, the door closer having at least one compression spring arranged in the housing of the door closer, with one end of the compression spring being braced against an adjustable spring plate, and a device actuatable from outside of the housing for adjusting the position of the spring plate.

A door closer of this kind is known, by way of example, from German laying open print No. 28 19 334.

In this known door closer angled gearing is used to adjust the spring plate and thus to adjust the bias of the closing spring. The angled gearing is in particular worm gearing by means of which a threaded spindle carrying the spring plate can be set in rotation and thus the spring plate linearly displaced.

The gearing used to displace the spring plate certainly makes it possible to adjust the closing force in a simple and problemfree manner, however, the operator has to count the number of rotations of the tool that occur when making the adjustment, because only in this manner is it possible to ensure a definite change from one specified closing force to another. If a particular closing force is to be recognisable when selected, for example for the purpose of subsequent checks, then this must be specially recorded.

The problem underlying the invention is to further develop a door closer of the initially named kind so that, with a minimum of effort, the closing force selected in any one case is immediately recognisable and so that marking steps additional to the adjustment step can be omitted.

This problem is solved by the invention in that a device is provided which can be influenced in dependence on the adjustment of the spring plate and which indicates the closing force corresponding to the prevailing spring bias.

In an advantageous development of this basic concept the device which indication the closing force is controlled in dependence on the actuating device which cooperates with the spring plate.

In the simplest case the indicating device can be formed directly by the spring plate, or by a part of this spring plate, or by a marking applied to the spring plate, there being an opening in the housing of the closer in the range of movement of the spring plate, with the opening being closed by a sightglass-like element.

In accordance with a further embodiment of the invention the indicating device comprises a pin coupled with the spring plate and sealingly guided through a closure cover of the housing. This indicating pin can itself be provided with a marking at its free end or it can be guided in a sleeve-like part bearing a marking so that the prevailing closing force can be recognised by the extent to which the indicating pin protrudes relative to the closure cover. The markings are applied by calibration in correspondence with the sizes of closers defined by specified closing forces.

The indicating pin can also take over an additional function, particularly in conjunction with floor-mounted door closers, namely the function of preventing rotation of the spring plate.

One form of the door closer of the invention, in which the spring plate is arranged on a threaded spindle and is driven via a worm drive, is characterised in that the indicating device comprises a threaded pin which engages in a threaded bore of the threaded spindle and is non-rotatably guided in a closure cover of the housing. The rotation of the threaded spindle thus necessarily results in axial displacement of the indicating pin, with the central passage of the indicating pin through the closure cover being particularly favourable because the seal of the threaded spindle in the closure cover simultaneously makes it possible for the indicating pin to pass through the closure cover without requiring additional sealing measures.

A further variant of the invention makes use of the rotation of a component of the actuating device which rotates when adjusting the closing force, by direct or indirect coupling of this component with an indicating device, which can for example consist of a counter. In this arrangement the counter is preferably arranged at the closure cover and is coupled with the threaded spindle via an axle.

In one special form of the invention the indicating device consists of an electrical instrument which is arranged in a circuit containing a potentiometer, with the potentiometer being adjustable in dependence on the linear movement of the spring plate or of the rotational movement of elements which actuate the spring plate.

Further embodiments of the invention, in which the device which indicates the prevailing closing force is connected with the spring plate by a magnetic coupling, are particularly advantageous because in this manner it is possible to avoid guides or passages in the housing of the closure which require sealing.

Further special features and advantageous details of the invention are set forth in the subordinate claims.

Figure 2:
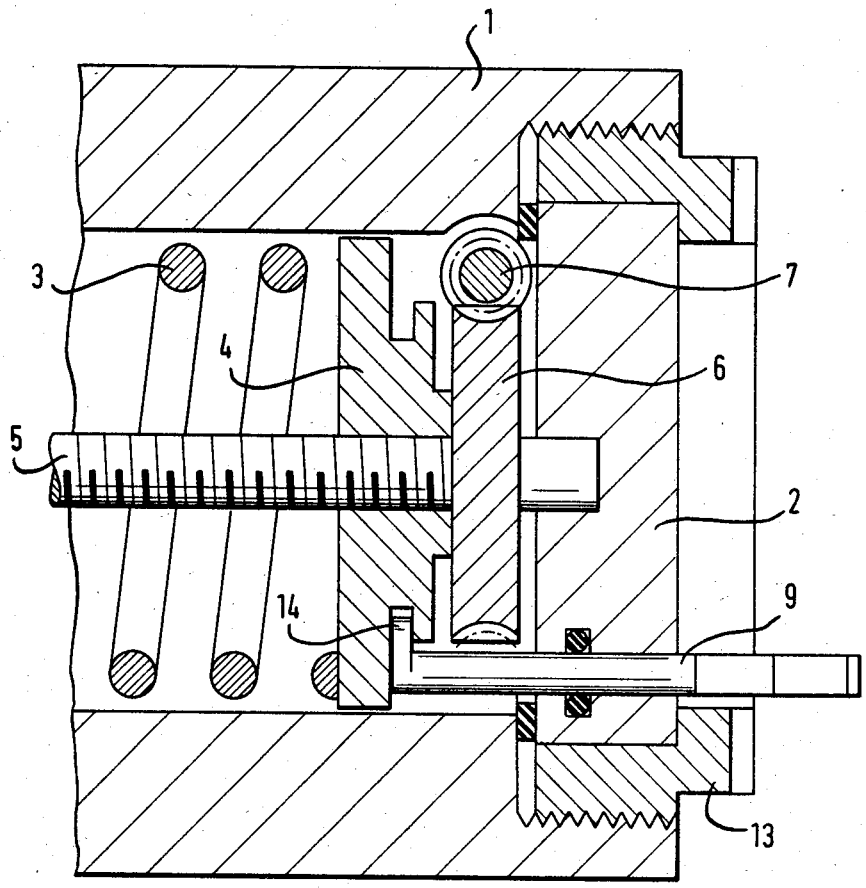
Figure 3:
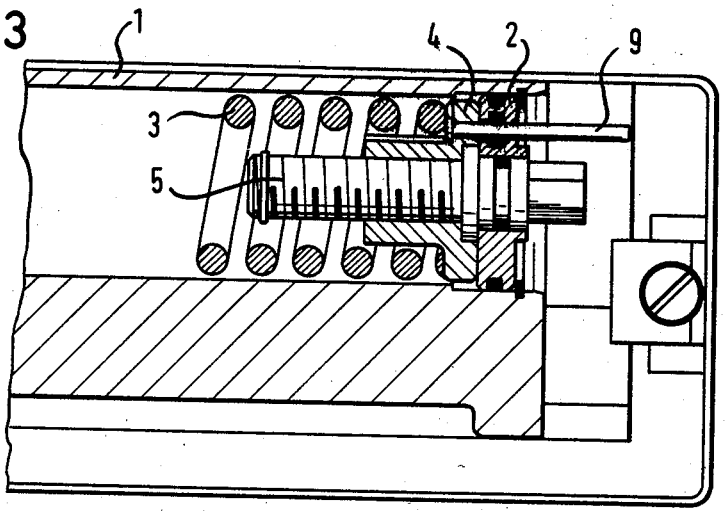
Figure 4:
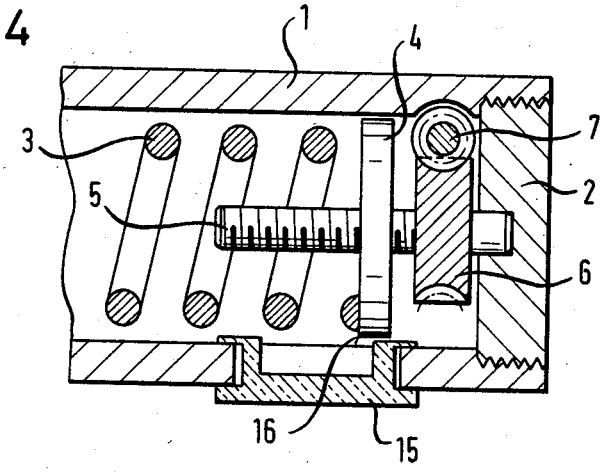
Figure 5:
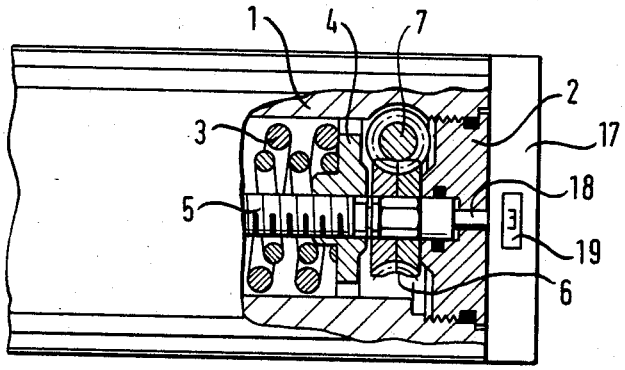
Figure 6:
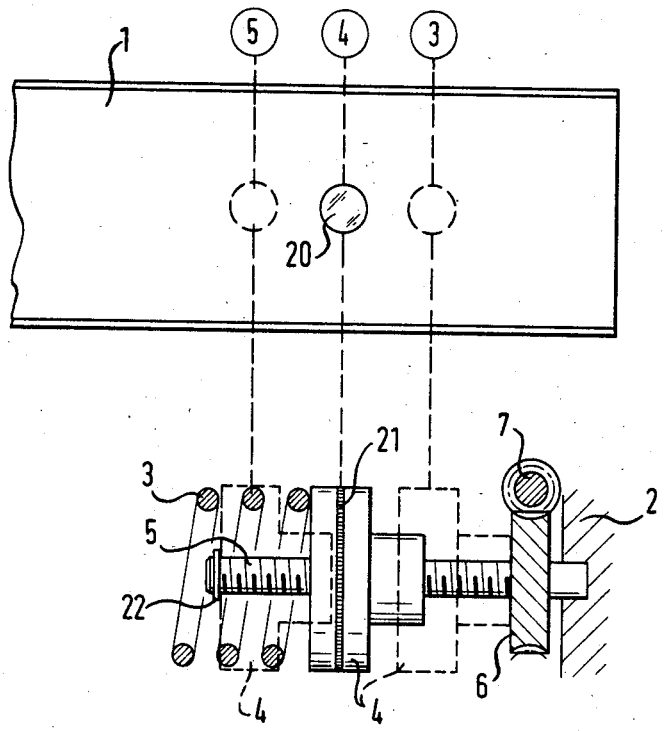
Figure 7:
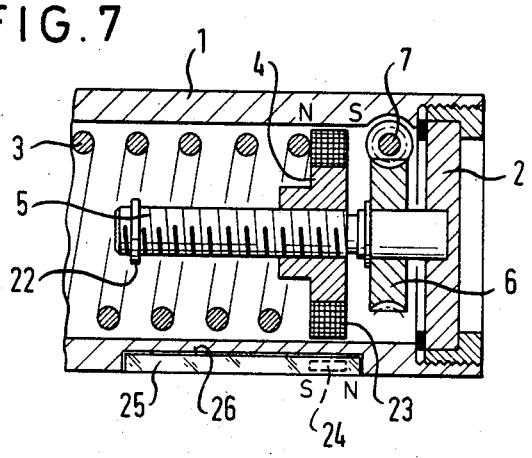
Figure 8:
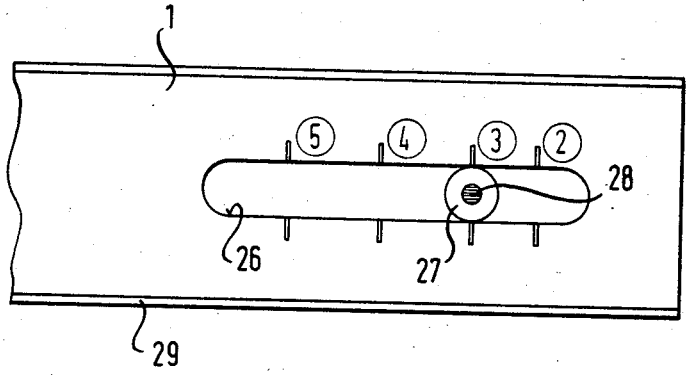
Figure 9:
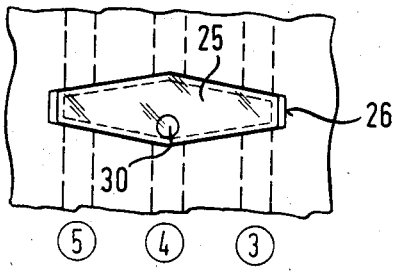

Embodiments of the invention will now be described in more detail in the following with reference to the drawings which show:

FIG. 1—a schematic part-longitudinal section of a door closer with an indicating device for the closing force, FIG. 2—a variant of the arrangement of FIG. 1, FIG. 3—a schematic, partly sectioned, partial view of a floor-mounted door closer with an indicating device for the closing force, FIG. 4—a view of a further embodiment corresponding to the illustration of FIG. 1, FIG. 5—a schematic, partly broken away and sectioned view of the end region of a further variant of a door closer provided with an indicating device, FIG. 6—a schematic illustration for the purpose of explaining a simplified adjustment and indication principle, FIG. 7—a schematic illustration of a further embodiment of the invention with a magnetically coupled indication device, FIG. 8—a schematic part-view of a front side of a door closer with an integrated indicating device, and FIG. 9—a schematic part-view of a variant of the indicating device of FIG. 7.

FIG. 1 shows an end section of a housing 1 for a door closer, the housing being closed at one end face by a cover 2 which is preferably constructed as a screw plug. A compression spring 3 is provided in the oil-filled housing 1 and is braced at one end on a piston guided within the housing and at the other end on a spring plate (or abutment) 4. This compression spring determines the closing force of the door closer and the intial bias of the compression spring can be varied by adjusting the position of the spring plate 4. Different closing moments can be preset by adjusting the initial bias of the compression spring 3. In this way the respectively prescribed closing forces or closing moments can be selected for door leaves of different widths and it is accordingly not necessary to manufacture and to store closers of different sizes for the various widths of door leaves.

The threaded spindle 5 which carries the spring plate 4 can be rotated via a worm wheel transmission comprising a worm wheel 6 and a worm 7 which can be actuated from the outside of the housing via a suitable tool, with the rotation of the threaded spindle 5 resulting in a linear displacement of the spring plate 4.

A threaded bore 8 is provided in the closure cover end of the threaded spindle 5 and serves to receive an indicating pin characterised with the general reference numeral 9. This indicating pin 9 has a threaded part 10 and a guide part 11 with the threaded part 10 engaging with the thread of the bore 8 and with the guide part 11 being guided in form-locked manner by an opening in the closure cover 2. This opening is for example of rectangular shape and thus prevents rotation of the indicating pin 11.

The outer end of the indicating pin 9 is located inside a transparent read-off member 12 which is secured to the closure cover 2 and provided with markings corresponding to the various closer settings.

If the threaded spindle 5 is rotated in order to select a specific closing moment the indicating pin 9 moves in the axial direction in proportion to the number of rotations of the threaded spindle 5 because its rotationally locked support means that it will either be screwed into or out of the bore as a result of rotational movement of the spindle 5. The prevailing closing force and/or the prevailing closing moment can then be read off from the markings.

In the embodiment illustrated in FIG. 2 the closure cover 2 is secured to the housing 1 of the closure with a suitable seal being interposed therebetween by means of a screwthreaded retainer 13 which engages over the closure cover 2 in flange-like manner.

The indicating pin 9 is sealingly guided through the closure cover 2, it is however connected not with the threaded spindle 5 but instead with the spring plate 4 by means of a coupling projection which engages in an annular groove of the spring plate 4. Each linear displacement of the spring plate 4 thus leads to a corresponding linear displacement of the indicating pin 9 so that a marking provided at the free end of the indicating pin 9 provides a direct indication of the selected closing force when related to the outer end surface of the closure cover 2.

FIG. 3 shows the case in which the indicator for the closing force is built into a floor mounted door closer. In this case the indicating pin 9 is once again connected with the spring plate 4 and extends through a sealed bore of the closure cover 2. The indicating pin 9 serves in this embodiment simultaneously as an indicating element and also as a means of preventing rotation of the spring plate.

FIG. 4 shows a particularly simple embodiment of the invention in which the spring plate 4, or an edge 16 of this spring plate 4, or a marking applied to the outer annular surface on the spring plate 4 directly serves as the indicating element. For this purpose a sightglass 15 is inserted into the wall of the housing in the range of movement of the spring plate 4 with the markings corresponding to the various closer settings being provided on the sightglass 15.

In the embodiment of an indicator for the closing force shown in FIG. 5 it is not the linear displacement of the spring plate 4 which is used to provide the indication but rather the rotational movement of the threaded spindle 5. For this purpose the threaded spindle 5 is connected at its closure cover end with a counter unit 17 via a coupling axle 18. The counter unit 17 shows the prevailing closing force and/or the prevailing closing torque in digital form in a sight window 19 in dependence on the number of rotations of the threaded spindle 5.

It is also possible to transmit the rotational movements of the worm wheel 6 or worm 7 to an indicator unit via suitable connecting elements, with a coupling being effected with one or other component of the actuating device depending on the indicating unit that it used.

The rotational movement or linear movement of the actuating device, spring plate or threaded spindle can also be used to adjust a potentiometer, in particular a spindle trim potentiometer or a slider potentiometer. In this case an electrical indicating device, which is inserted in the associated potentiometer circuit, can be appropriately calibrated so as to enable reading off of the prevailing closing force or the reading off of changes of the closing force.

The schematic illustration of FIG. 6 shows at its lower part, the compression spring 5 which is braced on the spring plate 4 and the initial bias of which can be adjusted by means of axial displacement of the spring plate 4 produced by rotation of the threaded spindle 5.

As the predetermined closing forces associated with different closer sizes are normed it is not necessary to provide a continuous indication of the closing force over the whole range adjustment.

In the embodiment of the invention shown in FIG. 6 the end positions are given for the closer sizes 3, 4 and 5. The closing force corresponding to the closer size 3 has been selected when, as illustrated in broken lines, the spring plate 4 abuts against the worm wheel 6, or against a corresponding collar of the threaded spindle 5.

The closer size 5 has been selected when, as likewise illustrated in broken lines, the spring plate 4 has come into contact with an end abutment 22, or a securing ring on the threaded spindle 5.

When selecting the closer sizes no difficulties are experienced in setting the sizes 3 and 5 because it is only necessary to rotate the adjustment screw in one or the other direction until the abutment is reached. As the contact of the spring plate 4 on an abutment can also be subsequently checked without difficulty it is possible to dispense with the provision of sight windows or glass lenses as indicated in broken lines in the upper part of FIG. 6.

The intermediate size 4, which lies between the size 3 and the size 5, must however be capable of being checked optically. For this purpose the spring plate 4 is provided with a peripheral marking 21 which can be recognised through a glass lens 20 provided in the housing 1. If the marking is located in the center of the glass lens 20 then the closer size 4 has been selected. The annular surface of the spring plate 4 is preferably coloured red and the marking 21 then consists of a peripheral black ring.

The glass lens 20 can be adhesively secured in pressure tight manner in a corresponding counter bore in the housing 1.

FIG. 7 shows a form of the invention in which the indicating device for the closing force is magnetically coupled with the spring plate 4. In this manner it is possible to avoid the need to provide the housing 1, which must always be of pressure tight construction, with additional openings or passages.

In this embodiment the spring plate 4 is constructed as an axially magnetised magnetic ring core or is provided with a magnetic ring core 23 of this kind. As a result of the axial magnetisation a concentrated magnetic field is formed between the north pole and the south pole, which must be imagineless lying at respective end faces, with this magnetic field permeating through the housing 1 of nonmagnetic material and cooperating with the oppositely disposed field of a round bar magnet 24, which is displaceable within a transparent tubule 25 arranged in a recess 26 of the housing. A strong magnetic coupling is present between the magnetic ring core 23 and the round bar magnet 24 and this ensures that the round bar magnet which forms the indicating device is always located at a position corresponding to the position of the spring plate 4, so that a direct indication of the selected closer setting/-size is possible.

In place of the round bar magnet 24 a drop of mercury can also be provided in the transparent tubule 25. In a further embodiment a liquid provided with metal particles or metal filings can be introduced into the tubule 25 with the metal particles always being concentrated in ring-like manner around the magnetic core 23, as a result of the magnetic field generated by the magnetic ring core 23, and thus forming an indicating device.

A particularly simple embodiment of an indicating device magnetically coupled with the spring plate is shown in FIG. 8. This indicating device 27 consists namely of a synthetic disc, in particular a teflon washer, which is preferably provided with a steel core and which is displaceable in a guide groove 26 in dependence on the movement of the adjustable spring plate in the housing of the closer. The guide groove 26 is provided with markings corresponding to the various sizes of closers. The washer 27 is preferably provided with a central indicator point 27 which is red in colour, so that both accurate selection of the respective size of closer and also rapid and simple reading off of the selected size of closer is possible.

As the indication of the closing force does not need to be permanently visible, but must only be settable during assembly or during a check, the indicating device is preferably provided beneath a cover plate for the frontside of the housing. The cover plate is held in known manner by means of guide rails 29.

The ring core magnet connected with or integrated into the spring plate 4 can be chamfered in the region of its outer periphery, so that an approximately roof-like configuration is achieved in section, so as to ensure a favourable shape of the magnetic field. In the same manner it is possible, for the purpose of achieving a shape of the magnetic field which is as concentrated and well defined as possible, to construct these permanent magnets from at least two partial magnets which have been assembled together under coercive pole formation.

The detail illustration of FIG. 9 shows an advantageous variant of the indicating device of FIG. 7. In this case a steel ball 30 is provided in the tubule 25 which consists of transparent plastic and which is arranged in a recess 26 of the housing. The steel ball 30 moves in the tubule in dependence on the displacement of the permanent magnet arranged inside the housing. The markings corresponding to the closer sizes 3, 4 and 5 are indicated in broken lines.

The diameter of the tubule 25 is largest at its center and reduces continuously towards the two ends. In this way the advantage is obtained that the required coupling between the permanent magnet and the steel ball, necessary to ensure the desired indication and which could be lost for example by a jolt during transport, can always be reestablished during assembly. This is achieved in that the capture range of the permanent magnet is always selected to be at least equal to one half the length of the tubule. As a result of the shaping of the tubule 25, the ball 30 will always move towards the central position during assembly and/or mounting of the closer and will thus always enter into the capture region of the permanent magnet, whereby the required coupling is at once reestablished.

All the described embodiments of the indicating device for the closing force have the common feature that they operate reliably and accurately as a result of their simple construction, cannot be arbitrarily misadjusted and always provide an exact and readily recognisable indication of the prevailing closing force and/or closing moment that has been selected.

Although the door closers of the present invention preferably operate with compression springs it is also possible to use tension springs without departing from the scope of the present invention.

We claim:

1. A door closer comprising a substantially horizontally extending non-magnetic housing with an outer wall having a recess; compression coil spring means disposed within said housing and having first and second ends; a spring plate disposed at said second end of said spring means and having a permanent magnet arranged thereon; means carrying said spring plate for adjustment movement within said housing to thereby adjust the position of said spring plate and said second end within said housing and relative to said first end to adjustably vary said spring bias; actuation means cooperating with said carrying means and accessible from outside of said housing for adjusting the position of said spring plate; a movable indicator device the position of which is readable from outside of said housing and consisting at least in part of a steel ball arranged in a transparent tubule secured in said recess and magnetically coupled to said permanent magnet, the tubule having a diameter which is largest at the center thereof and continuously reduces towards its two ends, whereby adjustment movement of said spring plate results in corresponding movement of said indicator device, thereby providing a reading of the selected level of said spring bias, the capture region of the permanent magnet being at least the same as one half of the length of the tubule.

* * * * *